US010883523B2

(12) United States Patent
Takakuwa et al.

(10) Patent No.: US 10,883,523 B2
(45) Date of Patent: Jan. 5, 2021

(54) FLUID PRESSURE CYLINDER

(71) Applicant: SMC CORPORATION, Chiyoda-ku (JP)

(72) Inventors: Youji Takakuwa, Kitakatsushika-gun (JP); Hiroyuki Asahara, Tsukuba (JP); Kengo Monden, Ushiku (JP); Aki Iwamoto, Kasukabe (JP); Naoki Shinjo, Nagareyama (JP); Kazutaka Someya, Kashiwa (JP); Akihiro Kazama, Moriya (JP)

(73) Assignee: SMC CORPORATION, Chiyoda-ku (JP)

( * ) Notice: Subject to any disclaimer, the term of this patent is extended or adjusted under 35 U.S.C. 154(b) by 0 days.

(21) Appl. No.: 16/334,943

(22) PCT Filed: Sep. 4, 2017

(86) PCT No.: PCT/JP2017/031794
§ 371 (c)(1),
(2) Date: Mar. 20, 2019

(87) PCT Pub. No.: WO2018/056037
PCT Pub. Date: Mar. 29, 2018

(65) Prior Publication Data

US 2020/0025224 A1 Jan. 23, 2020

(30) Foreign Application Priority Data

Sep. 21, 2016 (JP) ..... 2016-184199
Dec. 27, 2016 (JP) ..... 2016-253082

(51) Int. Cl.
*F15B 15/20* (2006.01)
*F15B 11/064* (2006.01)

(52) U.S. Cl.
CPC ..... *F15B 15/202* (2013.01); *F15B 11/064* (2013.01); *F15B 2211/7053* (2013.01); *F15B 2211/8855* (2013.01)

(58) Field of Classification Search
CPC ..... F15B 11/024; F15B 2211/75; F15B 11/02; F15B 2211/3058; F15B 2211/775; F15B 2211/3133; F15B 15/202; F15B 11/064
See application file for complete search history.

(56) References Cited

U.S. PATENT DOCUMENTS 3,165,981 A 1/1965 Amour
3,438,307 A 4/1969 Ahlenius
2019/0277310 A1 9/2019 Takakuwa et al.

FOREIGN PATENT DOCUMENTS

CN 103225632 A 7/2013
DE 1 601 740 A1 1/1971
(Continued)

OTHER PUBLICATIONS

International Search Report and Written Opinion dated Dec. 20, 2017 in PCT/JP2017/031794 filed on Sep. 4, 2017.
(Continued)

*Primary Examiner* — Abiy Teka
(74) *Attorney, Agent, or Firm* — Oblon, McClelland, Maier & Neustadt, L.L.P.

(57) ABSTRACT

A cylinder main body of a fluid pressure cylinder includes a switch valve, a check valve, and a flow path communicating a high pressure air supply source with a head side cylinder chamber and communicating an exhaust port with a rod side cylinder chamber when the switch valve is at a second position. Another flow path communicates the head side cylinder chamber with the rod side cylinder chamber and the exhaust port when the switch valve is at the first position.

15 Claims, 16 Drawing Sheets

(56) References Cited

FOREIGN PATENT DOCUMENTS

| | | | | |
|---|---|---|---|---|
| DE | 1601740 | A1 * | 1/1971 | ..... F15B 11/024 |
| DE | 20 2017 105 319 | U1 | 11/2017 | |
| EP | 2 620 657 | A2 | 7/2013 | |
| FR | 2 524 580 | A1 | 10/1983 | |
| JP | 51-133674 | A | 11/1976 | |
| JP | 58-118303 | A | 7/1983 | |
| JP | 2-2965 | Y2 | 1/1990 | |
| JP | 3-153902 | A | 7/1991 | |
| JP | 2005-83512 | A | 3/2005 | |
| JP | 2009-275770 | A | 11/2009 | |
| JP | 2013-137062 | A | 7/2013 | |
| JP | 2018-54117 | A | 4/2018 | |

OTHER PUBLICATIONS

Japanese Office Action dated May 7, 2019 in Japanese Patent Application No. 2016-253082 (with English translation). citing documents AO, AP and AQ therein. 6 pages.

Office Action dated Nov. 5, 2019 in corresponding Japanese Patent Application No. 2016-253082 (with English Translation), citing document AO therein, 10 pages.

Korean Office Action dated Apr. 29, 2020, in Patent Application No. 10-2019-7011489, citing documents AO-AP therein, 12 pages (with English translation).

Combined Chinese Office Action and Search Report dated Dec. 4, 2019, in Patent Application No. 201780058308.3 (with English translation), citing document AO therein, 16 pages.

Indian Office Action dated Aug. 27, 2020 in Indian Patent Application No. 201947015273 (with English translation), citing documents AA, AO and AP therein, 6 pages.

* cited by examiner

20

120

120

120

120A

FLUID PRESSURE CYLINDER

TECHNICAL FIELD

The present invention relates to a fluid pressure cylinder. More particularly, the present invention relates to a double acting fluid pressure cylinder that does not need a large driving force in a return process of a piston that reciprocates inside the fluid pressure cylinder.

DESCRIPTION OF THE RELATED ART

Conventionally, a driving device of a double acting actuator driven by air pressure is known which needs a larger output in a forward moving (driving) process and does not need a larger output in a return process (see Japanese Utility Model Publication No. 2-002965).

As shown in FIG. 16, this actuator driving device recovers and accumulates, in an accumulator 12 during the returning of a piston 2, part of exhaust air discharged from a drive side pressure chamber 3 of a double acting cylinder device 1 and uses the part of exhaust air as return power of the double acting cylinder device 1. More specifically, when a switch valve 5 is switched to a state depicted in FIG. 16, a high pressure exhaust air in a drive side pressure chamber 3 is accumulated in the accumulator 12 through a recovery port 10*b* of a recovery valve 10. When an exhaust air pressure lowers and a difference between the exhaust air pressure and an accumulator pressure becomes small, remaining air in the drive side pressure chamber 3 is discharged from a exhaust port 10*c* of the recovery valve 10 to the atmosphere, and accumulated pressure air of the accumulator 12 simultaneously flows in a return side pressure chamber 4.

BACKGROUND ART

The actuator driving device has a problem that, even when the switch valve 5 is switched, until the difference between the discharge air pressure and the accumulator pressure becomes small, the high pressure air in the drive side pressure chamber 3 is not discharged to the atmosphere, and therefore it takes time to obtain a thrust necessary for the double acting cylinder device 1 to return. The recovery valve 10 has to take a complex structure that connects an inlet port 10*a* of the recovery valve 10 with the recovery port 10*b* while a pressure difference between the exhaust air pressure and the accumulator pressure is large, and connects the inlet port 10*a* with the exhaust port 10*c* when the pressure difference between the exhaust air pressure and the accumulator pressure is small. There is a problem that a tube is additionally required that connects the recovery valve 10 etc. with the double acting cylinder device 1, and the actuator driving device as a whole becomes large.

The present invention has been made by taking such a problem into account. An object of the present invention is to save energy by returning a piston of a fluid pressure cylinder reusing a discharge pressure, and reduce a necessary return time of the piston as much as possible. Another object of the present invention is to simplify a circuit for a reciprocating motion of the piston of the fluid pressure cylinder by reusing a discharge pressure, and miniaturize the fluid pressure cylinder including the circuit.

A fluid pressure cylinder according to the present invention is a double acting fluid pressure cylinder that includes a cylinder main body in which a piston reciprocates, and the cylinder main body includes a switch valve including a discharge port, a supply check valve, a flow path communicating one cylinder chamber with a fluid supply source and communicating the other cylinder chamber with at least the discharge port when the switch valve is at a first position, and a flow path communicating the one cylinder chamber with the other cylinder chamber via the supply check valve and communicating the one cylinder chamber with at least the discharge port when the switch valve is at a second position.

The fluid pressure cylinder supplies fluid accumulated in the one cylinder chamber to the other cylinder chamber and at the same time, discharges fluid to the outside. As a result, the fluid pressure in the other cylinder chamber increases and the fluid pressure in the one cylinder chamber rapidly decreases. Consequently, it is possible to reduce as much as possible a time necessary for the piston of the fluid pressure cylinder to return. The recovery valve with a complicated structure is not necessary, and a simple circuit configuration such as the supply check valve only needs to be employed. Consequently, it is possible to simplify a circuit that returns the piston of the fluid pressure cylinder. A cylinder main body is provided with the switch valve including the discharge port, the supply check valve, and the flow path that returns the piston of the fluid pressure cylinder by reusing a discharge pressure. Consequently, it is possible to integrally form the cylinder main body and the switch valve and substantially miniaturize the fluid pressure cylinder.

In the fluid pressure cylinder, the switch valve is preferably arranged at an upper portion of the one cylinder chamber and at sides of the one cylinder chamber and the other cylinder chamber. Consequently, it is possible to shorten the flow path that connects the switch valve and the one cylinder chamber. Consequently, it is possible to further miniaturize the fluid pressure cylinder.

In the fluid pressure cylinder, a first tank is preferably arranged between the other cylinder chamber and the switch valve. Consequently, it is possible to accumulate the fluid discharged from the one cylinder chamber in the first tank that is connected with the other cylinder chamber, and prevent, in the return step, a pressure of the fluid from lowering as much as possible when the volume of the other cylinder chamber increases.

In the fluid pressure cylinder, the first tank is preferably arranged at an upper portion of the other cylinder chamber or at a lower portion of the switch valve. Consequently, it is possible to shorten the flow path that connects the first tank and the other cylinder chamber, and further miniaturize the fluid pressure cylinder.

A volume of the first tank is approximately half a maximum value of a fluctuating volume of the one cylinder chamber. Consequently, it is possible to achieve a proper balance between a function of quickly increasing the fluid pressure of the other cylinder chamber when the fluid accumulated in the one cylinder chamber is supplied to the other cylinder chamber, and a function of preventing the pressure of the fluid from lowering when the volume of the other cylinder chamber increases.

In the fluid pressure cylinder, a throttle valve is preferably arranged at the discharge port. Consequently, it is possible to limit the amount of the fluid discharged to the outside and sufficiently save energy.

The throttle valve is preferably a variable throttle valve. Consequently, it is possible to adjust a ratio of the amount of the fluid accumulated in the one cylinder chamber and supplied toward the other cylinder chamber, to the amount of the fluid accumulated in the one cylinder chamber and discharged to the outside.

In the fluid pressure cylinder, a second tank is preferably further provided and is connected to the throttle valve in parallel with respect to the switch valve. In this case, when the switch valve is at the first position, the other cylinder chamber communicates with the throttle valve and the second tank via the switch valve. Meanwhile, when the switch valve is at the second position, the one cylinder chamber communicates with the other cylinder chamber via the supply check valve and the switch valve, and communicates with the throttle valve and the second tank via the switch valve.

Consequently, part of the fluid discharged from the discharge port to the outside is accumulated in the second tank, so that it is possible to reduce the amount of consumed fluid by the amount of fluid accumulated in the second tank. As a result, it is possible to further save energy of the fluid pressure cylinder.

In this case, by arranging a pressure accumulator check valve between the switch valve and the second tank, it is possible to prevent the fluid once accumulated in the second tank from being discharged to the outside via the discharge port.

A first fluid supply mechanism is preferably further arranged and is configured to supply a fluid accumulated in the second tank to the other cylinder chamber when the switch valve is at the second position and when part of a fluid accumulated in the one cylinder chamber is supplied from the one cylinder chamber to the other cylinder chamber via the supply check valve and the switch valve.

Consequently, when the pressure of the fluid supplied from the one cylinder chamber to the other cylinder chamber lowers, the fluid is supplied from the second tank to the other cylinder chamber via the first fluid supply mechanism. As a result, it is possible to reliably and efficiently return the fluid pressure cylinder.

A second fluid supply mechanism is further arranged and is configured to supply the fluid from the fluid supply source to the second tank. Consequently, it is possible to prevent the pressure of the fluid from lowering when the fluid accumulated in the second tank is used.

Preferably, in the fluid pressure cylinder, the first tank and the second tank are arranged in parallel inside the cylinder main body, the switch valve is arranged at an upper portion of the first tank, and an air-operated valve is arranged at an upper portion of the second tank and forms the second fluid supply mechanism, and the piston, the one cylinder chamber, and the other cylinder chamber are arranged between the switch valve and the air-operated valve.

The first tank and the switch valve, and the second tank, and the air-operated valve are symmetrically arranged with respect to the piston, the one cylinder chamber, and the other cylinder chamber, so that it is easy to build the fluid pressure cylinder. As a result, it is possible to reduce manufacturing cost while improving productivity of the fluid pressure cylinder.

In this case, the piston has an elliptical shape along the vertical direction, so that it is possible to prevent the piston from rotating in a circumferential direction.

A magnet is disposed at an upper portion of the piston, and magnetic sensors configured to detect magnetism of the magnet are disposed near the one cylinder chamber and the other cylinder chamber in the cylinder main body, respectively. Consequently, it is possible to easily dispose a piston position detecting mechanism in the fluid pressure cylinder of the symmetrical structure.

The first tank and the second tank have approximately the same volume, so that it is possible to further improve productivity of the fluid pressure cylinder, and further reduce manufacturing cost of the fluid pressure cylinder.

The above and other objects, features and advantages of the present invention will become more apparent from the following description when taken in conjunction with the accompanying drawings in which a preferred embodiment of the present invention is shown by way of illustrative example.

DESCRIPTION OF EMBODIMENTS

A preferred embodiment of a fluid pressure cylinder according to the present invention will be described below with reference to the accompanying drawings.

1. Configuration of Present Embodiment

Figure 1:
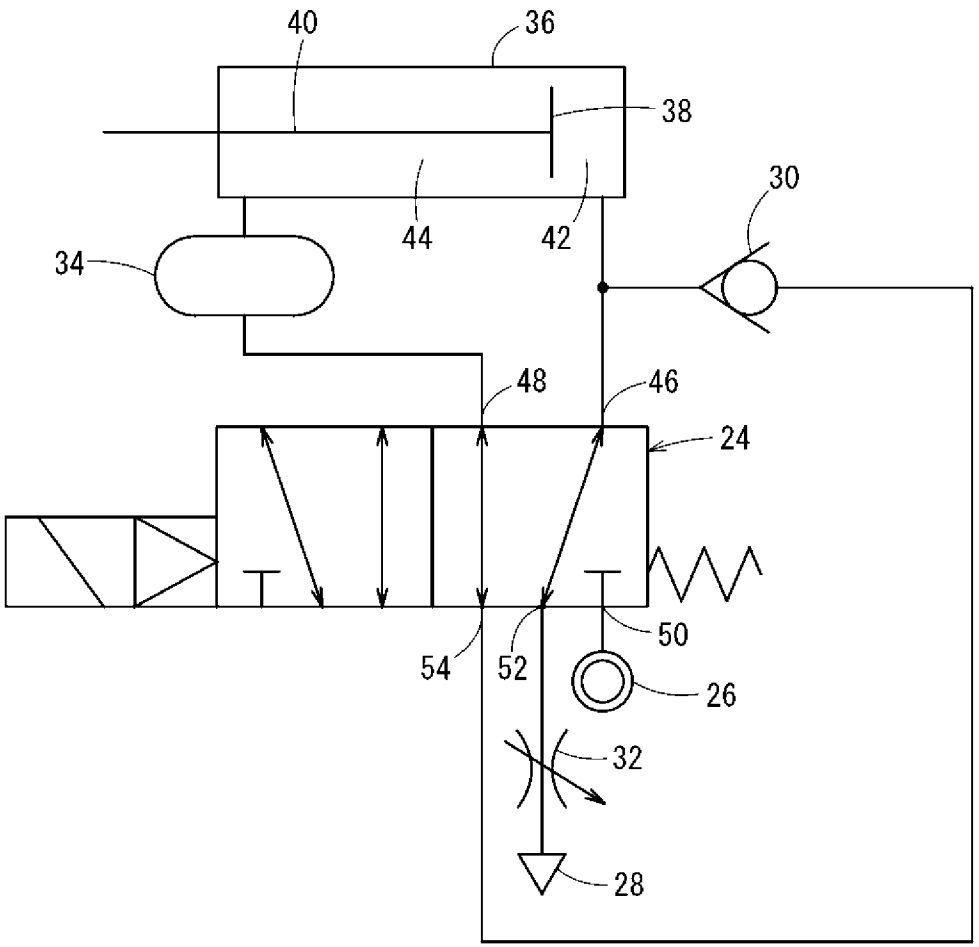
FIG. 1 is a circuit diagram of a fluid pressure cylinder according to an embodiment of the present invention.

As shown in FIG. 1, a fluid pressure cylinder 20 according to an embodiment of the present invention is applied to a double acting air cylinder. The fluid pressure cylinder 20 includes a switch valve 24, a high pressure air supply source (fluid supply source) 26, an exhaust port (discharge port) 28, a check valve (supply check valve) 30, a throttle valve (first throttle valve) 32, an air tank (first tank) 34, and predetermined tubes that fluidly connects the components above.

The fluid pressure cylinder 20 includes a piston 38 reciprocally slidably disposed inside a cylinder main body 36. A piston rod 40 includes one end portion that is coupled to the piston 38 and the other end portion that can extend from the cylinder main body 36 to the outside. The fluid pressure cylinder 20 illustrated herein performs work such as the positioning of a workpiece (not shown) when the piston rod 40 is pushed out (moves forward), and does not perform work when the piston rod 40 retracts (returns). The cylinder main body 36 includes two cylinder chambers partitioned by the piston 38, i.e., a head side cylinder chamber (one cylinder chamber) 42 located at a side opposite to the piston rod 40, and a rod side cylinder chamber (other cylinder chamber) 44 located at the same side as the piston rod 40.

Figure 2:
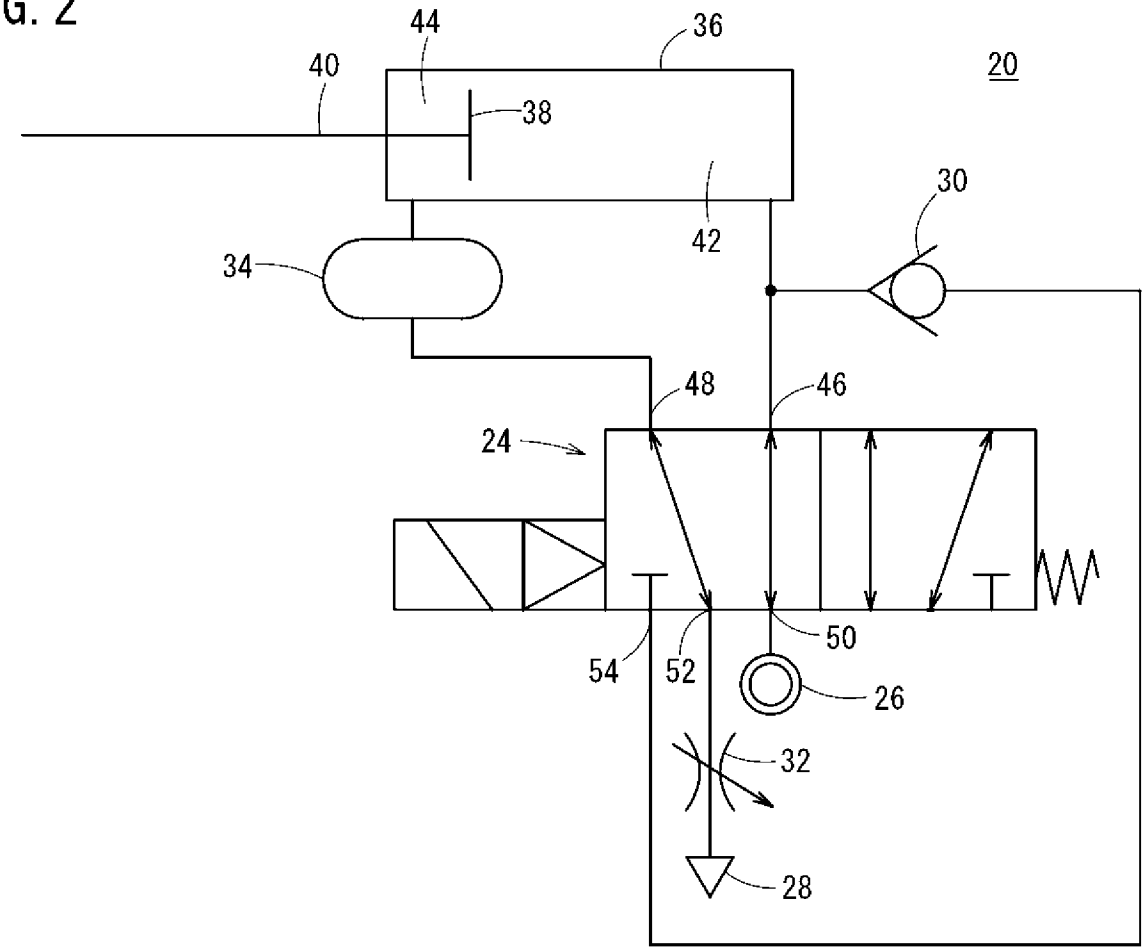
FIG. 2 is a circuit diagram in a case where a switch valve shown in FIG. 1 is at another position.

The switch valve 24 is configured as a solenoid valve that includes a first port 46 to a fifth port 54 and can be switched between a first position shown in FIG. 2 and a second position shown in FIG. 1. Provisionally, when the piston 38 in the cylinder main body 36 is in a state of FIG. 1, the state will be referred to as a second position, and a state in FIG. 2 will be referred to as a first position. The first port 46 is connected to the head side cylinder chamber 42 through the tube, and is connected to an upstream side of the check valve 30. The second port 48 is connected to the rod side cylinder chamber 44 through a tube via the air tank 34. The third port 50 is connected to the high pressure air supply source 26 through a tube. The fourth port 52 is connected to the exhaust port 28 through a tube via the throttle valve 32. The fifth port 54 is connected to a downstream side of the check valve 30 through a tube.

As shown in FIG. 1, when the switch valve 24 is at the second position, the first port 46 and the fourth port 52 are connected, and the second port 48 and the fifth port 54 are connected. As shown in FIG. 2, when the switch valve 24 is at the first position, the first port 46 and the third port 50 are connected, and the second port 48 and the fourth port 52 are connected. The switch valve 24 is held at the second position by a spring biasing force while electric power is not provided, and is switched from the second position to the first position when electric power is provided. Electric power is provided or not with respect to the switch valve 24 when a PLC (Programmable Logic Controller) (not shown) that is a higher level device outputs a power provision command (power provision) or outputs a power provision stop command (non-power provision) to the switch valve 24.

When the switch valve 24 is at the second position, the check valve 30 allows an air flow from the head side cylinder chamber 42 toward the rod side cylinder chamber 44, and blocks the air flow from the rod side cylinder chamber 44 toward the head side cylinder chamber 42.

The throttle valve 32 is arranged to limit the amount of air discharged from the exhaust port 28 and is configured as a variable throttle valve that can change a path area to adjust the amount of air to be discharged.

The air tank 34 is arranged to accumulate air supplied from the head side cylinder chamber 42 to the rod side cylinder chamber 44. Having the air tank 34 is equivalent to increasing the volume of the rod side cylinder chamber 44. The volume of the air tank 34 is set, for example, to half (approximately half is sufficient) the volume of the head side cylinder chamber 42 when the piston rod 40 extends to a maximum position (to approximately half the maximum value of the fluctuating volume of the head side cylinder chamber 42).

2. Operation of Present Embodiment

The fluid pressure cylinder 20 according to the present embodiment is basically configured as described above. A function (operation) of the fluid pressure cylinder 20 will be described below with reference to FIGS. 1 and 2. As shown in FIG. 1, a state where the piston rod 40 retracts most is set to be an initial state.

When electric power is provided to the switch valve 24 and the switch valve 24 is switched from the second position (see FIG. 1) to the first position (see FIG. 2) in this initial state, a driving process is performed. The driving process includes supplying the high pressure from the high pressure air supply source 26 to the head side cylinder chamber 42 and discharging air of the rod side cylinder chamber 44 to the exhaust port 28 via the throttle valve 32. In the driving process, the piston rod 40 extends to the maximum position as shown in FIG. 2, and is held at the maximum position by a large thrust.

When the piston rod 40 extends and does an operation such as the positioning of the workpiece and then the electric power provision to the switch valve 24 is stopped, the switch valve 24 is switched from the first position to the second position, and the return process is performed. In the return process, part of the air accumulated in the head side cylinder chamber 42 is supplied toward the rod side cylinder chamber 44 through the check valve 30. Simultaneously, the other part of the air accumulated in the head side cylinder chamber 42 is discharged from the exhaust port 28 via the throttle valve 32. In this case, the air supplied toward the rod side cylinder chamber 44 is mainly accumulated in the air tank 34. This is because, before the piston rod 40 starts retracting, the air tank 34 occupies the largest volume among the space stretching between the check valve 30 and the rod side cylinder chamber 44 where air can be present, the space including the rod side cylinder chamber 44 and the tubes. Subsequently, when the air pressure of the head side cylinder chamber 42 decreases, the air pressure of the rod side cylinder chamber 44 rises, and when the air pressure of the rod side cylinder chamber 44 becomes larger by a predetermined value than the air pressure of the head side cylinder chamber 42, the piston rod 40 starts retracting. Further, the piston rod 40 returns to the initial state where the piston rod 40 retracts most.

Figure 3:
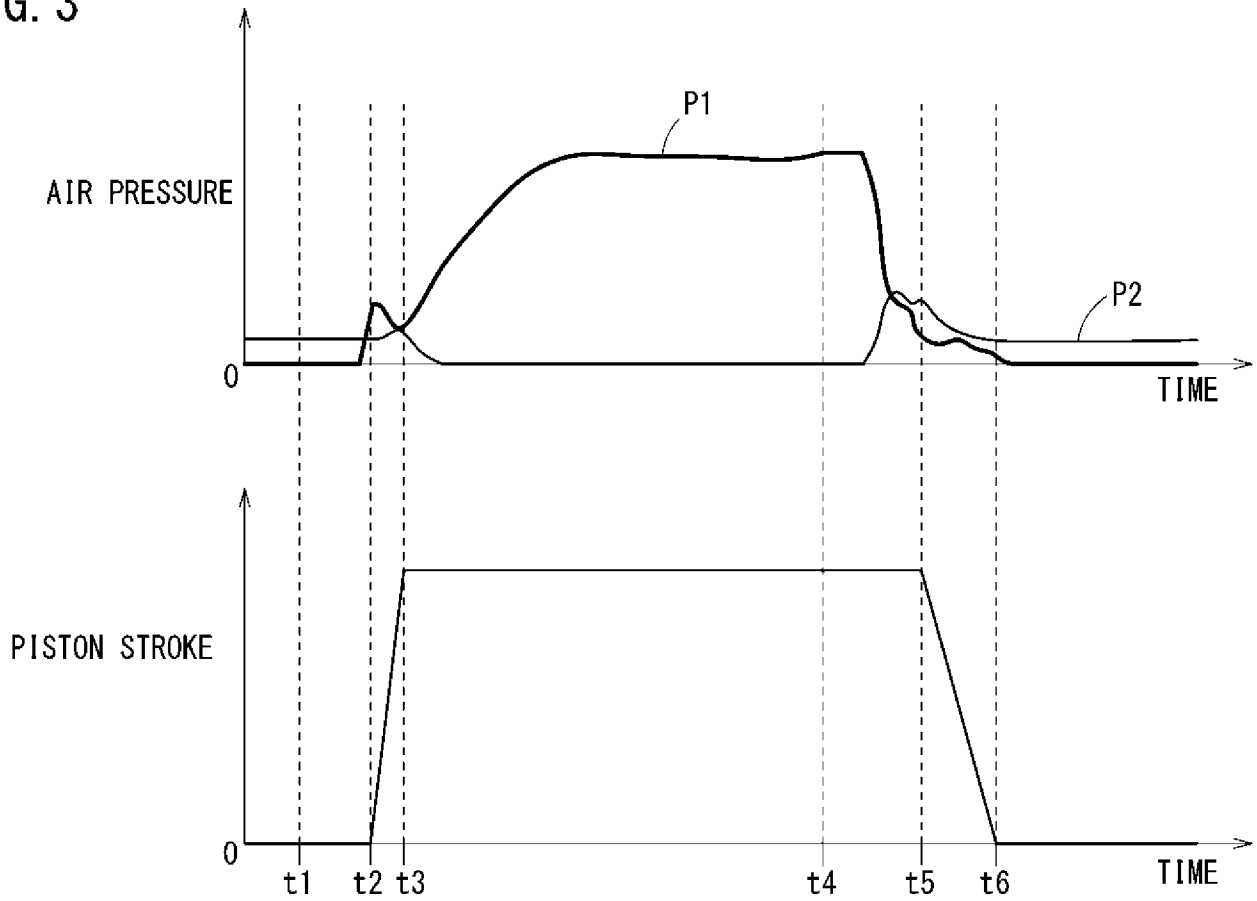
FIG. 3 is a view showing a result obtained by measuring an air pressure of each cylinder chamber and a piston stroke during an operation of the fluid pressure cylinder in FIG. 1.

FIG. 3 shows a result obtained by measuring an air pressure P1 of the head side cylinder chamber 42, an air pressure P2 of the rod side cylinder chamber 44, and a piston stroke in a series of the above operations. An operation principle (the driving process and the return process) of the fluid pressure cylinder 20 will be described in detail below with reference to FIG. 3. In FIG. 3, a zero point of the air pressure indicates that the air pressure is equal to an atmospheric pressure, and a zero point of the piston stroke indicates that the piston rod 40 is at a position at which the piston rod 40 has retracted most.

First, the driving process according to the operation principle of the fluid pressure cylinder 20 will be described. At a time t1 at which the power provision command is outputted to the switch valve 24, the air pressure P1 of the head side cylinder chamber 42 is equal to the atmospheric pressure, and the air pressure P2 of the rod side cylinder chamber 44 is slightly larger than the atmospheric pressure.

When the power provision command is outputted to the switch valve 24 and then the switch valve 24 is switched from the second position (see FIG. 1) to the first position (see FIG. 2), the air pressure P1 of the head side cylinder chamber 42 starts rising. At a time t2, the air pressure P1 of the head side cylinder chamber 42 exceeds the air pressure P2 of the rod side cylinder chamber 44 by an amount that is more than a static friction resistance of the piston 38, and the piston rod 40 starts moving in a push-out direction (left direction in FIG. 2). Subsequently, at a time t3, the piston rod 40 stretches most. The air pressure P1 of the head side cylinder chamber 42 further rises and then becomes a fixed pressure, and the air pressure P2 of the rod side cylinder chamber 44 lowers and becomes equal to the atmospheric pressure. A temporary decrease in the air pressure P1 of the head side cylinder chamber 42 and a temporary rise in the air pressure P2 of the rod side cylinder chamber 44 between the time t2 and the time t3 are caused by an increase in a volume of the head side cylinder chamber 42 and a decrease in a volume of the rod side cylinder chamber 44.

Next, the return process of the operation principle according to the fluid pressure cylinder 20 will be described. When the power provision stop command is outputted to the switch valve 24 at a time t4, and the switch valve 24 is switched from the first position to the second position, the air pressure P1 of the head side cylinder chamber 42 starts lowering, and the air pressure P2 of the rod side cylinder chamber 44 starts rising. When the air pressure P1 of the head side cylinder chamber 42 becomes equal to the air pressure P2 of the rod side cylinder chamber 44, the check valve 30 functions to stop supply of the air of the head side cylinder chamber 42 to the rod side cylinder chamber 44 whereby the rise of the air pressure P2 of the rod side cylinder chamber 44 halts. Meanwhile, the air pressure P1 of the head side cylinder chamber 42 continues lowering, the air pressure P2 of the rod side cylinder chamber 44 exceeds, at a time t5, the air pressure P1 of the head side cylinder chamber 42 by an amount that is more than the static friction resistance of the piston 38, and the piston rod 40 starts moving in a drawing direction (a right direction in FIG. 1).

As the piston rod 40 moves in the drawing direction, the volume of the rod side cylinder chamber 44 increases. Therefore, the air pressure P2 of the rod side cylinder chamber 44 lowers. However, the air pressure P1 of the head side cylinder chamber 42 lowers at a larger rate. Therefore, the air pressure P2 of the rod side cylinder chamber 44 continues exceeding the air pressure P1 of the head side cylinder chamber 42. A sliding friction of the piston 38 that has once started moving is smaller than a friction resistance of the piston 38. Therefore, the piston rod 40 smoothly moves in the drawing direction. When the piston rod 40 retracts, the air pressure in the air tank 34 is also naturally used as a drawing force (pressing force) with respect to the piston 38.

At a time t6, the piston rod 40 returns to a state where the piston rod 40 retracts most. At this time, the air pressure P1 of the head side cylinder chamber 42 is equal to the atmospheric pressure, and the air pressure P2 of the rod side cylinder chamber 44 is slightly larger than the atmospheric pressure. This state is maintained until a next power provision command is outputted to the switch valve 24.

In the fluid pressure cylinder 20, the throttle valve 32 is arranged to limit the amount of air discharged from the exhaust port 28. However, the throttle valve 32 is not an indispensable component.

Figure 4:
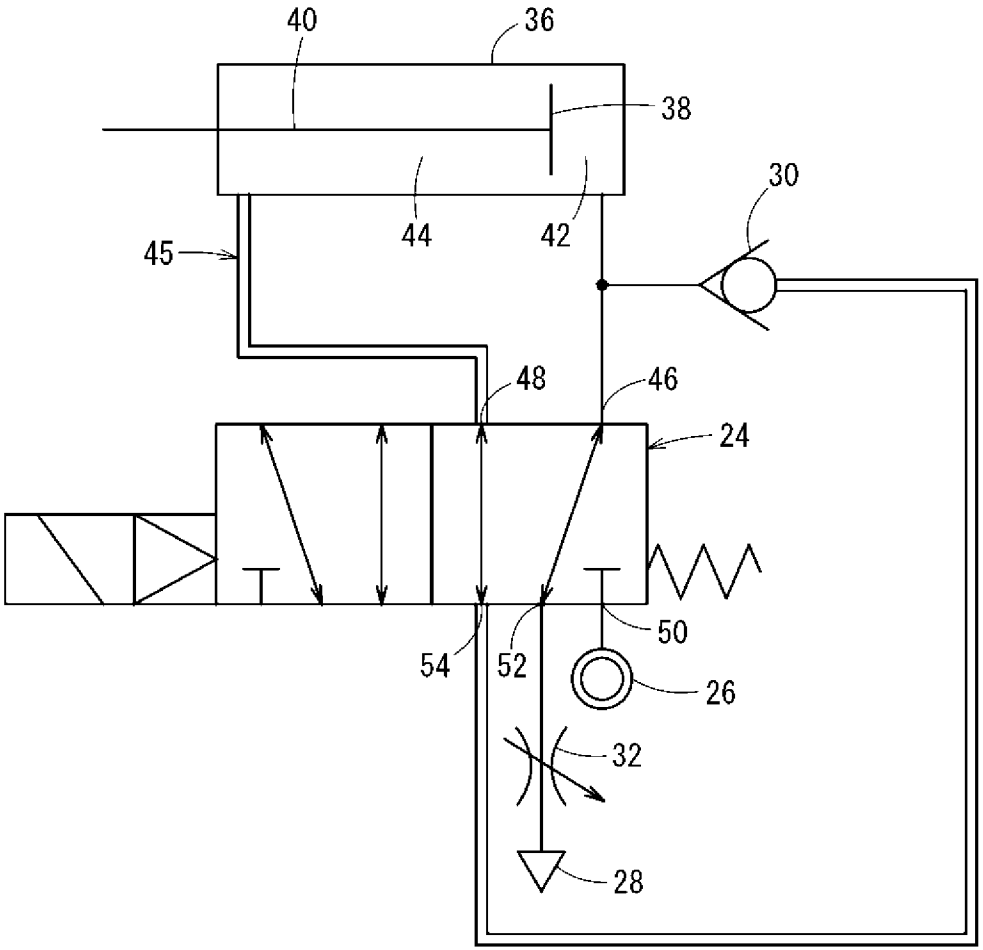
FIG. 4 is a circuit diagram of the fluid pressure cylinder according to another embodiment of the present invention.

The air tank 34 is arranged in the fluid pressure cylinder 20. However, as shown in FIG. 4, the volume of a tube 45 extending from the check valve 30 to the rod side cylinder chamber 44 across the switch valve 24 may be made larger than the volume of other tubes in the fluid pressure cylinder 20. Consequently, it is possible to sufficiently secure the volume in the tube extending from the check valve 30 to an inlet of the rod side cylinder chamber 44 across the switch valve 24, omit the air tank 34, and easily obtain the same effect as a case where the air tank 34 is arranged.

3. Specific Structure of Present Embodiment

A basic configuration and the function of the fluid pressure cylinder 20 according to the embodiment of the present invention are as described above. Various structures can be employed for specific arrangements of various components.

As an example of a structure, FIGS. 5 to 10 show a fluid pressure cylinder 120 in which a cylinder main body and a switch valve are integrally formed.

Those components of the fluid pressure cylinder 120 that correspond to the components of the fluid pressure cylinder 20 will be assigned reference numerals that are equal to 100 plus each reference numeral of each component of the fluid pressure cylinder 20, and will not be described in detail.

Figure 5:
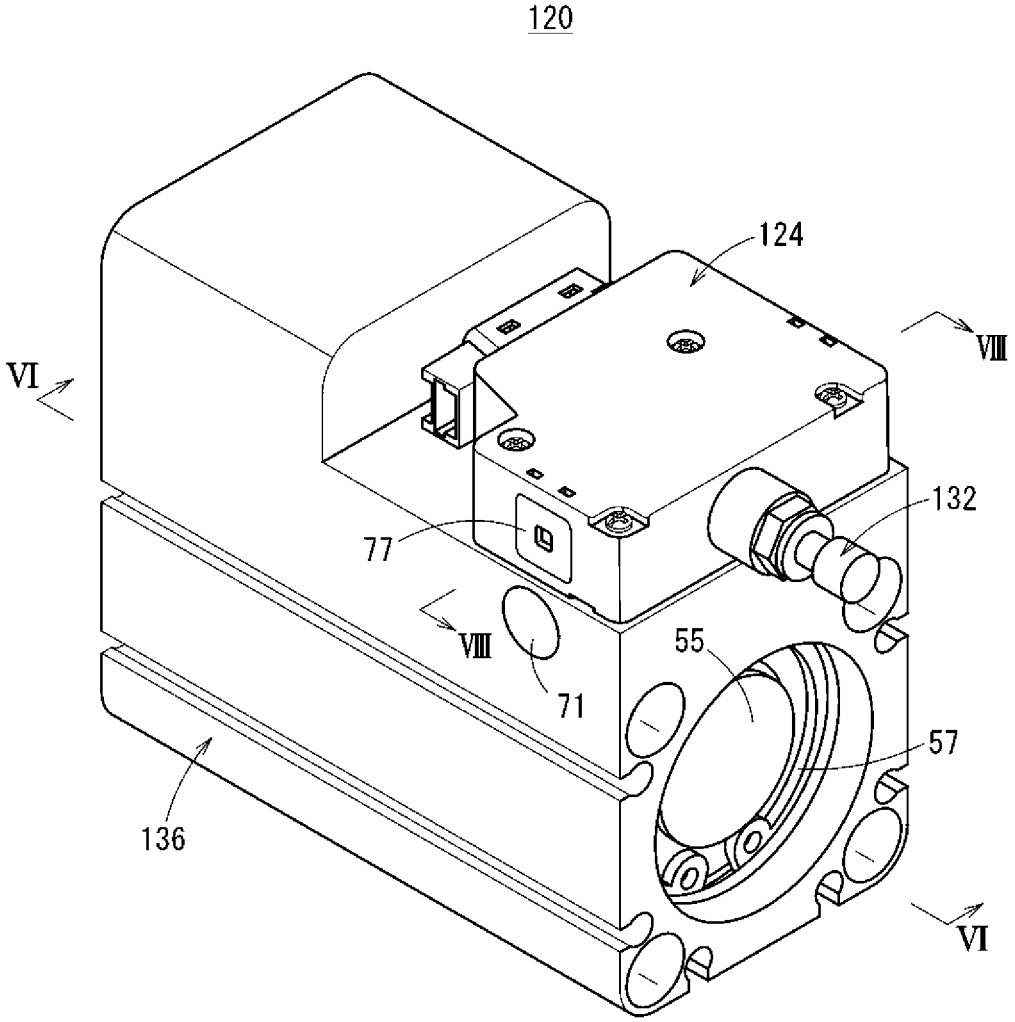
FIG. 5 is a perspective view showing the fluid pressure cylinder according to the embodiment of the present invention seen from a head side.

FIG. 5 is a perspective view showing the fluid pressure cylinder 120 according to the embodiment of the present invention seen from a head side. As shown in FIG. 5, the fluid pressure cylinder 120 includes a cylinder main body 136, a switch valve 124 arranged at an upper portion of the cylinder main body 136, and a throttle valve (variable throttle valve) 132 arranged on a side surface of the switch valve 124 in a protruding manner.

Figure 6:
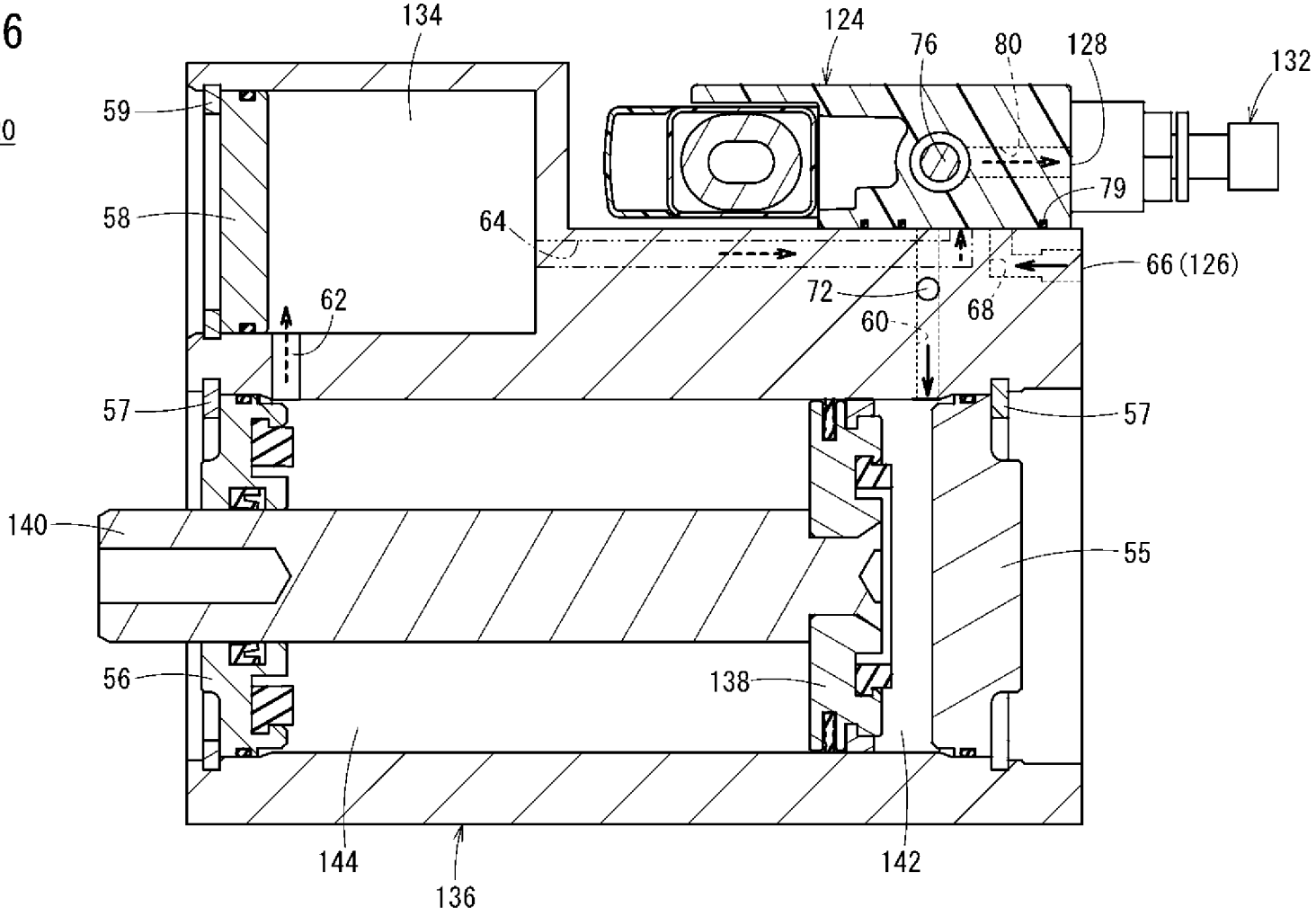
FIG. 6 is a cross-sectional view along a VI-VI line in FIG. 5.

FIG. 6 is a cross-sectional view along a VI-VI line of FIG. 5. As shown in FIG. 6, the cylinder main body 136 includes a piston 138 reciprocally slidably arranged inside the cylinder main body 136, and a piston rod 140 including one end portion that is coupled to the piston 138 and another end portion that extends from the cylinder main body 136 to the outside.

The cylinder main body 136 includes two cylinder chambers partitioned by the piston 138, i.e., a head side cylinder chamber (one cylinder chamber) 142 and a rod side cylinder chamber (other cylinder chamber) 144. The head side cylinder chamber 142 and the rod side cylinder chamber 144 are closed by cover members 55, 56, respectively and the cover members 55, 56 are fixed by a retaining ring 57. The head side cylinder chamber 142 is connected to a first port 146 of the switch valve 124 (described later) via a flow path 60.

The cylinder main body 136 includes an air tank 134 disposed at an upper portion of the rod side cylinder chamber 144. The air tank 134 is closed by a cover member 58, and the cover member 58 is fixed by a retaining ring 59. The air tank 134 communicates with the rod side cylinder chamber 144 via a flow path 62, and is connected to a second port 148 of the switch valve 124 (described later) via a flow path 64.

Figure 7:
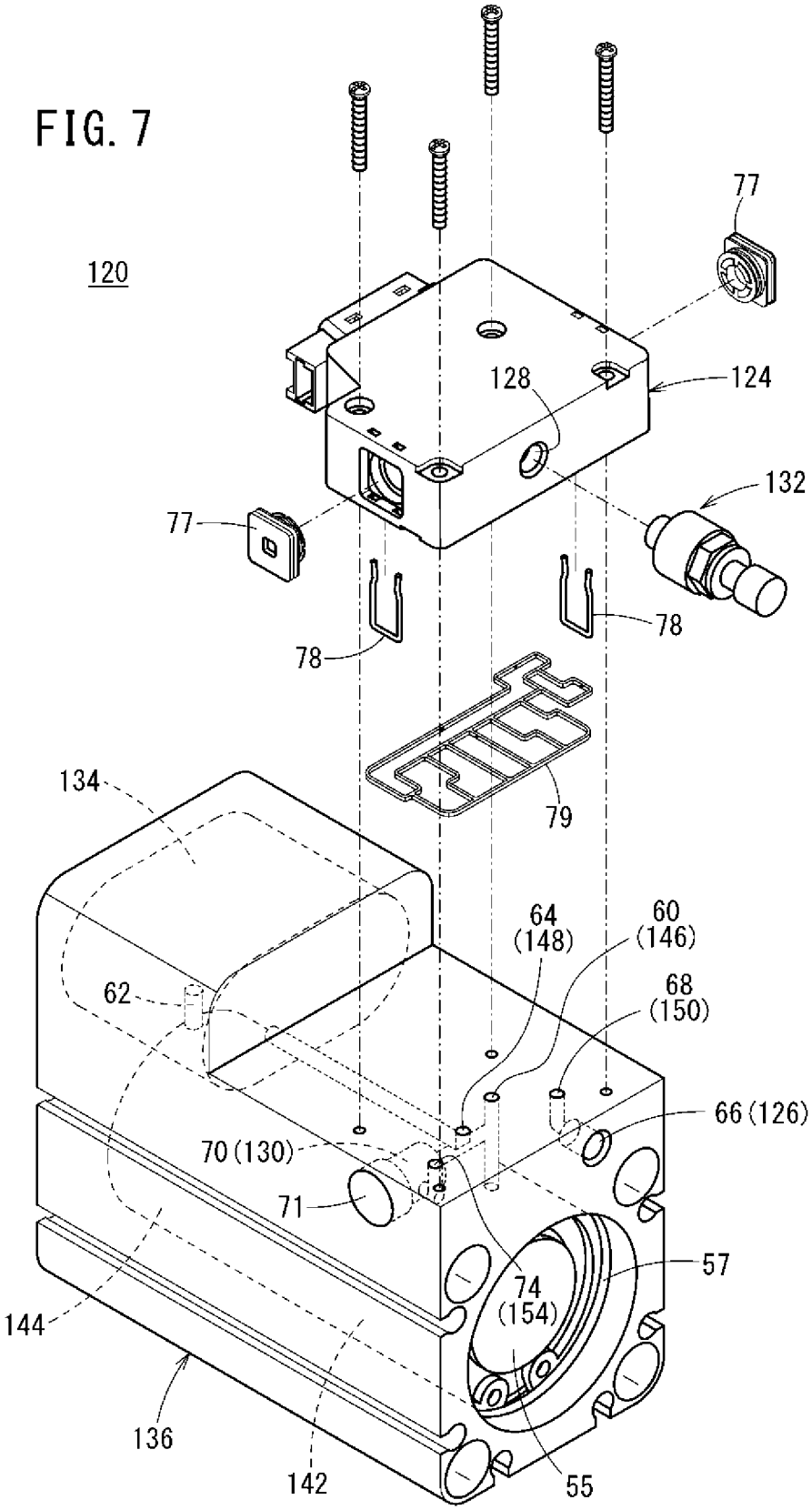
FIG. 7 is a partial exploded perspective view of the fluid pressure cylinder shown in FIG. 5.

As shown in FIG. 7, the cylinder main body 136 includes a high pressure air introduction port 66 on a side surface opposite to the side surface from which the piston rod 140 protrudes. The high pressure air introduction port 66 receives a high pressure air (pressure fluid) from a high pressure air supply source (high pressure supply source) 126 that is not shown. The high pressure air introduction port 66 is connected to a third port 150 of the switch valve 124 described below via a flow path 68.

Figure 8:
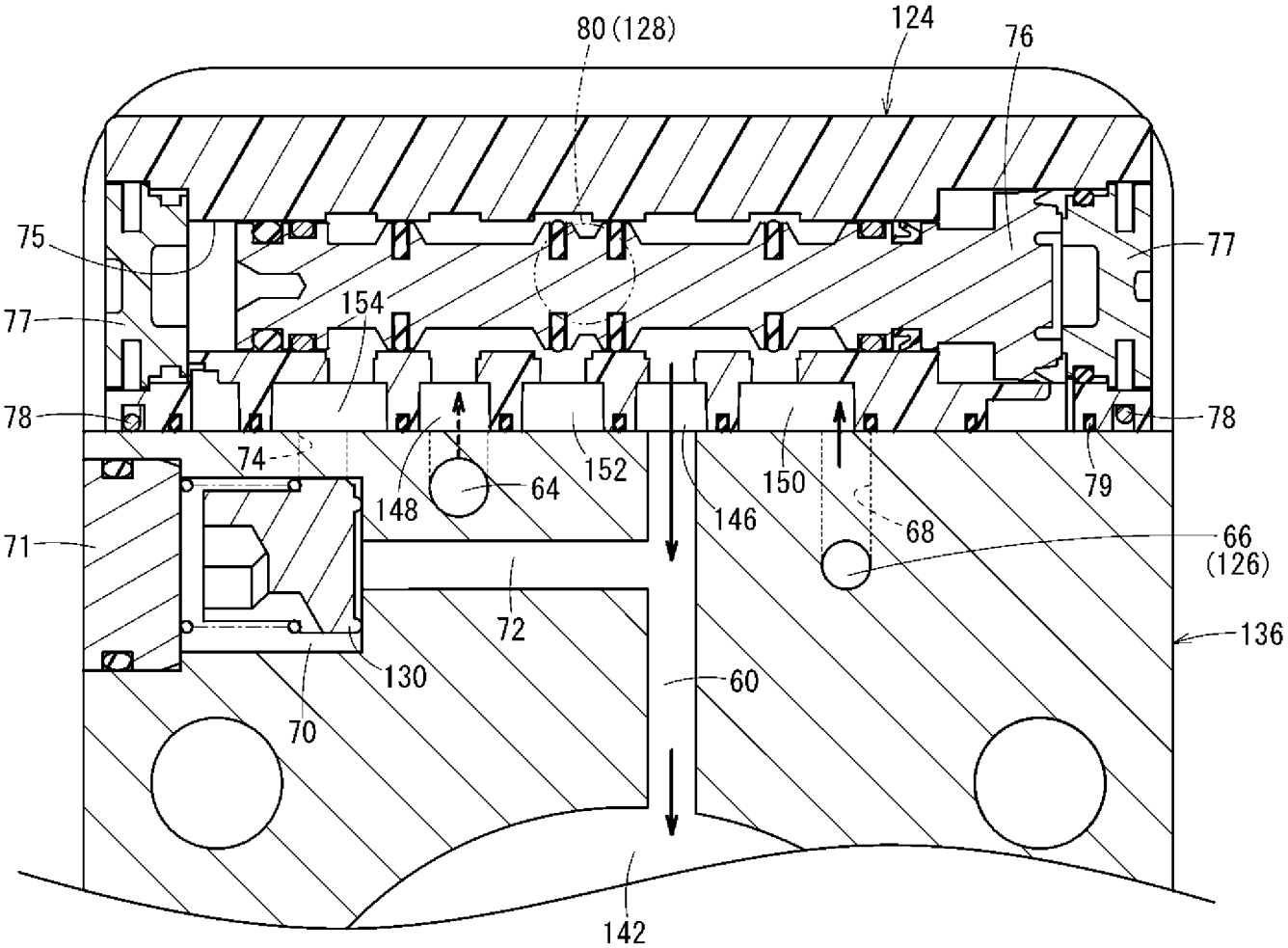
FIG. 8 is a cross-sectional view along a VIII-VIII line in FIG. 5.
Figure 9:
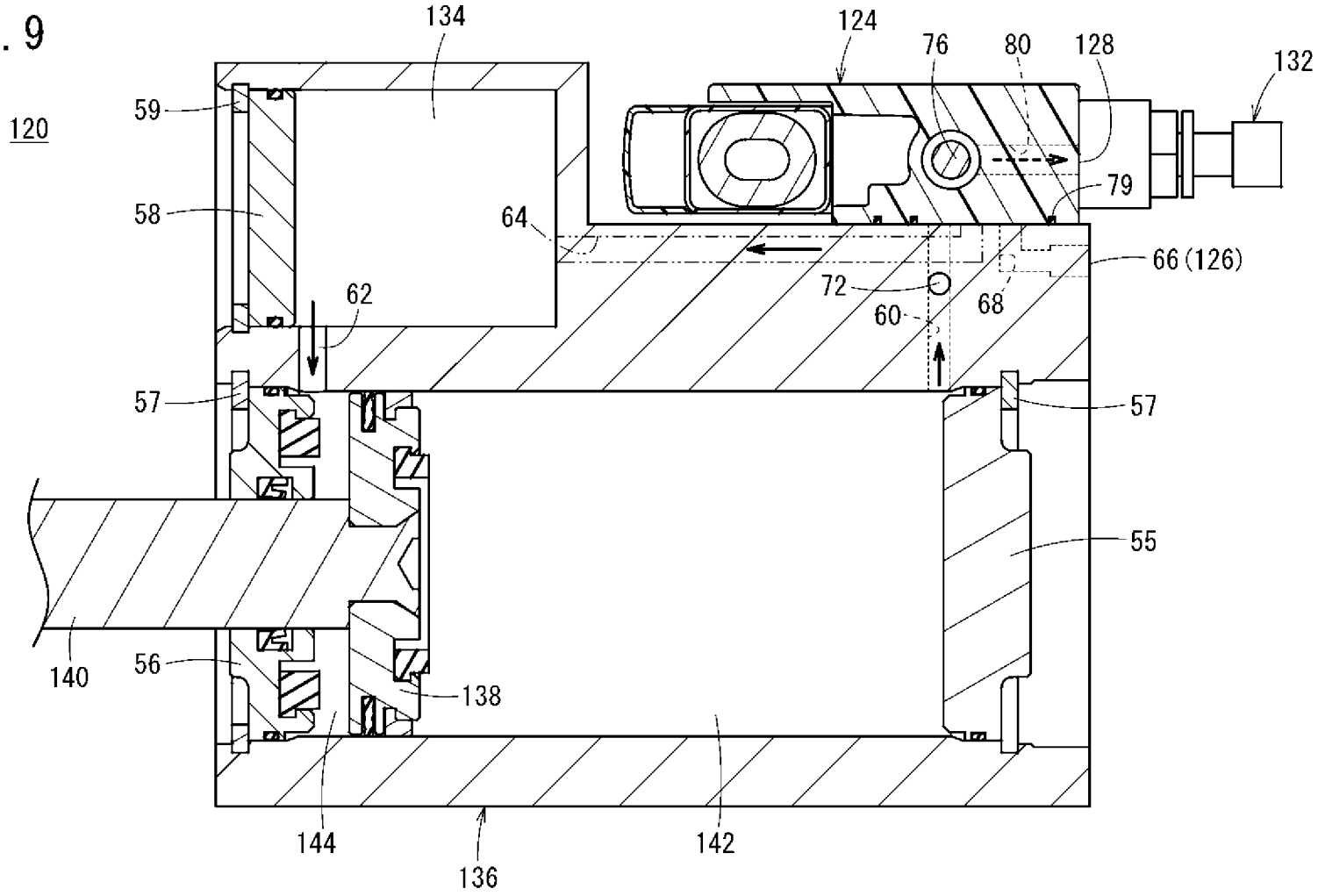
FIG. 9 is a cross-sectional view along a VI-VI line in FIG. 5 when the switch valve is at another position.

FIG. 8 is a cross-sectional view along a VIII-VIII line in FIG. 5. As shown in FIG. 8, the cylinder main body 136 includes at an upper portion of the head side cylinder chamber 142 a small space 70 in which a check valve 130 is housed. The small space 70 is closed by a cover member 71. The small space 70 communicates with the flow path 60 via the flow path 72, and is connected to a fifth port 154 of the switch valve 124 described below via a flow path 74.

The check valve 130 allows an air flow from the head side cylinder chamber 142 toward the fifth port 154 of the switch valve 124, and blocks the air flow from the fifth port 154 of the switch valve 124 toward the head side cylinder chamber 142.

The switch valve 124 is configured as a solenoid valve that includes the first port 146 to the fifth port 154, and can be switched between a first position and a second position when a spool valve 76 is displaced in an axial direction in a cylindrical sleeve 75. Provisionally, when the spool valve 76 is in a state of FIG. 8, the state will be referred to as the first position, and a state in FIG. 10 will be referred to as the second position. Both ends of the sleeve 75 are closed by cover members 77, and the cover members 77 are fixed by stops 78.

As shown in FIG. 7, the switch valve 124 is screwed to a top surface of the cylinder main body 136 with a gasket 79 interposed therebetween. An exhaust port 128 is opened in a side surface on a head side of the switch valve 124, and the throttle valve 132 is arranged at the exhaust port 128. As shown in FIGS. 6 and 8, the exhaust port 128 is connected to the fourth port 152 of the switch valve 124 via a flow path 80 arranged inside the switch valve 124.

The first port 146 of the switch valve 124 is connected to the head side cylinder chamber 142 with the flow path 60, and is connected to an upstream side of the check valve 130 with the flow path 60 and the flow path 72. The second port 148 is connected to the air tank 134 with the flow path 64, and is connected to the rod side cylinder chamber 144 via the flow path 62. The third port 150 is connected to the high pressure air supply source 126 (not shown) with the flow path 68 and the high pressure air introduction port 66. The fourth port 152 is connected to the exhaust port 128 with the flow path 80. The fifth port 154 is connected to a downstream side of the check valve 130 with the flow path 74.

As shown in FIG. 8, when the switch valve 124 is at the first position, the first port 146 and the third port 150 are connected, and the second port 148 and the fourth port 152 are connected. That is, when electric power is provided to the switch valve 124 and the switch valve 124 is switched from the second position to the first position, the high pressure air supply source 126 supplies the high pressure air to the high pressure air introduction port 66. Next, the high pressure air is supplied to the head side cylinder chamber 142 via the flow path 68, the third port 150, the first port 146, and the flow path 60. In this case, air of the rod side cylinder chamber 144 is discharged from the exhaust port 128 via the flow path 62, the air tank 134, the flow path 64, the second port 148, the flow path 80, and the throttle valve 132.

Figure 10:
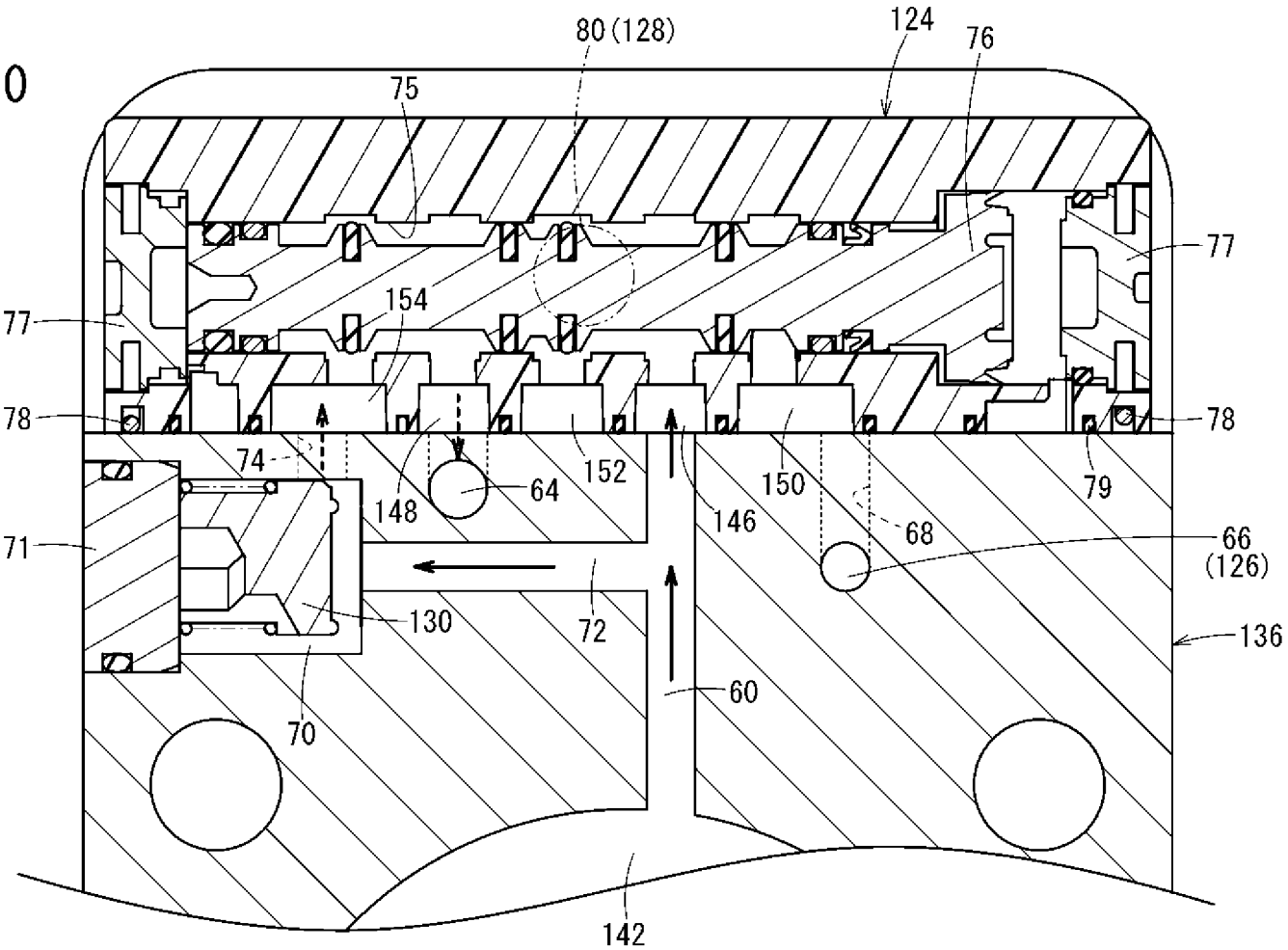
FIG. 10 is a cross-sectional view along a VIII-VIII line in FIG. 5 when the switch valve is at another position.

Meanwhile, as shown in FIG. 10, when the switch valve 124 is at the second position, the first port 146 and the fourth port 152 are connected, and the second port 148 and the fifth port 154 are connected. That is, when electric power provision to the switch valve 124 stops, and the switch valve 124 is switched from the first position to the second position, part of the air accumulated in the head side cylinder chamber 142 is supplied to the rod side cylinder chamber 144 through the flow path 60, the flow path 72, the check valve 130, the fifth port 154, the second port 148, the flow path 64, the air tank 134, and the flow path 62. Simultaneously, the other part of the air accumulated in the head side cylinder chamber 142 is discharged from the exhaust port 128 through the flow path 60, the first port 146, the fourth port 152, the flow path 80, and the throttle valve 132.

4. Effect of Present Embodiment

As described above, the fluid pressure cylinders 20, 120 according to the present embodiment supply the fluids accumulated in the head side cylinder chambers 42, 142 toward the rod side cylinder chambers 44, 144, and at the same time, discharge the fluids to the outside. Hence, the fluid pressure in the rod side cylinder chambers 44, 144 increase and the fluid pressure in the head side cylinder chambers 42, 142 rapidly decrease. Consequently, it is possible to shorten, as much as possible, a time necessary for the pistons 38, 138 of the fluid pressure cylinders 20, 120 to return.

The recovery valve with a complicated structure is not necessary, and only a simple circuit configuration such as the check valves 30, 130 is required. Consequently, it is possible to simplify the circuit for the returning of the pistons 38, 138.

The cylinder main bodies 36, 136 include the switch valves 24, 124 that include the exhaust ports 28, 128; the check valves 30, 130; and the flow paths 60, 62, 64, 68, 72, 74, 80 that return the pistons 38, 138 by reusing a discharge pressure. Consequently, it is possible to integrally form the cylinder main bodies 36, 136 and the switch valves 24, 124, and substantially miniaturize the fluid pressure cylinders 20, 120.

The switch valve 124 is arranged at the upper portion of the head side cylinder chamber 142. Consequently, it is possible to shorten the flow path 60 that connects the switch valve 124 and the head side cylinder chamber 142 and to further miniaturize the fluid pressure cylinder 120.

The air tanks 34, 134 are arranged between the rod side cylinder chambers 44, 144 and the switch valves 24, 124. Consequently, it is possible to accumulate the fluids discharged from the head side cylinder chambers 42, 142, in the air tanks 34, 134 connected to the rod side cylinder chambers 44, 144, and to prevent, as much as possible, pressures of the fluids from lowering when the volumes of the rod side cylinder chambers 44, 144 increase in the return process.

The air tank 134 is arranged at the upper portion of the rod side cylinder chamber 144. Consequently, it is possible to shorten the flow path 62 that connects the air tank 134 and the rod side cylinder chamber 144, and to further miniaturize the fluid pressure cylinder 120.

The volumes of the air tanks 34, 134 are approximately half the maximum value of the fluctuating volumes of the head side cylinder chambers 42, 142. Consequently, when the fluids accumulated in the head side cylinder chambers 42, 142 are supplied toward the rod side cylinder chambers 44, 144, it is possible to achieve a proper balance between the function of quickly increasing the fluid pressures of the rod side cylinder chambers 44, 144 and a function of preventing the pressures of the fluids from lowering when the volumes of the rod side cylinder chambers 44, 144 increase.

The throttle valves 32, 132 are arranged at the exhaust ports 28, 128. Consequently, it is possible to limit the amount of the fluids discharged to the outside, and sufficiently save energy.

In this case, the throttle valves 32, 132 are variable throttle valves. Consequently, the throttle valves 32, 132 can adjust a ratio of the amount of the fluid accumulated in the head side cylinder chambers 42, 142 and supplied toward the rod side cylinder chambers 44, 144, to the amount of the fluid accumulated in the head side cylinder chambers 42, 142 and discharged to the outside.

In the fluid pressure cylinder 120, the switch valve 124 is arranged at the upper portion of the head side cylinder chamber 142, and the air tank 134 is arranged at the upper portion of the rod side cylinder chamber 144. However, the switch valve 124 and the air tank 134 do not necessarily need to be arranged at the upper portions of the head side cylinder chamber 142 and the rod side cylinder chamber 144. For example, in relation to an installation space of the fluid pressure cylinder 120, the switch valve 124 and the air tank 134 may be arranged on a side surface in a longitudinal direction of the cylinder main body 136 or a side surface on the head side.

In the fluid pressure cylinder 120, the piston rod 140 coupled to the piston 138 reciprocates along an axial direction of the cylinder main body 136. However, the fluid pressure cylinder according to the present invention is not necessarily limited to this configuration. A double acting actuator that needs a large output in the driving process but does not need a large output in the return process is applicable to various fluid pressure devices such as rotary actuators and grippers.

5. Modification of Present Embodiment

Next, modifications (fluid pressure cylinders 20A, 120A) of the fluid pressure cylinders 20, 120 according to the present embodiment will be described with reference to FIGS. 11 to 15. The same components as those in the fluid pressure cylinder 20 in FIGS. 1 and 2 and the fluid pressure cylinder 120 in FIGS. 5 to 10 will be assigned the same reference numerals to describe this modification, and will not be described in detail.

Figure 11:
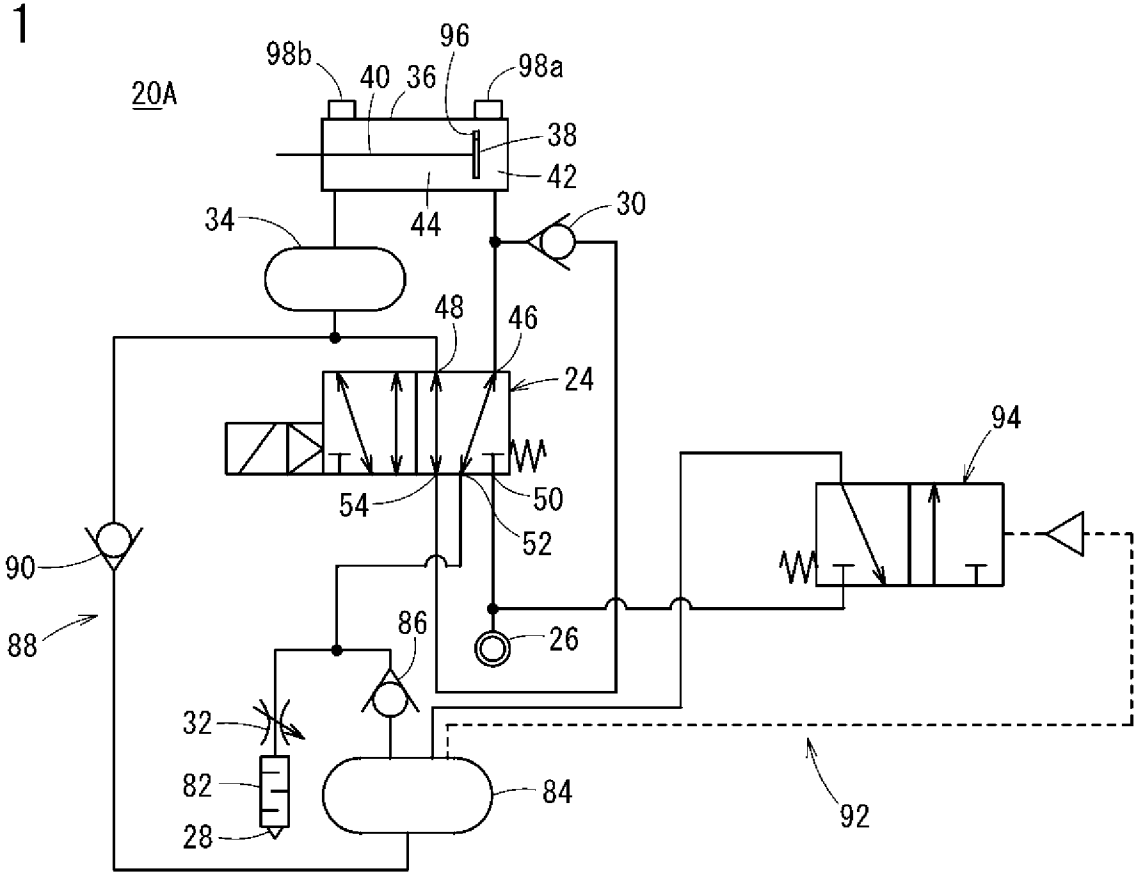
FIG. 11 is a circuit diagram of a fluid pressure cylinder according to a modification.

In the fluid pressure cylinder 20A according to this modification, the throttle valve 32, a silencer 82, and the exhaust port 28 are connected to the fourth port 52 in series by a tube as shown in FIG. 11.

In this case, the fluid pressure cylinder 20A further includes an air tank (second tank) 84. The air tank 84 is connected to the throttle valve 32, the silencer 82, and the exhaust port 28 in parallel by a tube via a check valve (pressure accumulator check valve) 86. Hence, according to this modification, the throttle valve 32 and the exhaust port 28, and the air tank 84 are connected to the fourth port 52 in parallel.

According to the modification, when the switch valve 24 is at the second position as shown in FIG. 11, the head side cylinder chamber 42 communicates with the rod side cylinder chamber 44 via the check valve 30 and the switch valve 24, and communicates with the exhaust port 28 and the air tank 84 via the switch valve 24. When the switch valve 24 is at the first position, the rod side cylinder chamber 44 communicates with the exhaust port 28 and the air tank 84 via the switch valve 24.

Even when the switch valve 24 is at either of the first position and the second position in the fluid pressure cylinder 20A according to this modification, it is possible to accumulate part of air discharged from the fourth port 52 to the outside via the exhaust port 28, in the air tank 84 via the check valve 86. Consequently, it is possible to reduce the amount of air consumption of the fluid pressure cylinder 20A by the amount of air accumulated in the air tank 84. As a result, it is possible to further save energy of the fluid pressure cylinder 20A.

In the fluid pressure cylinder 20A, the check valve 86 is disposed between the switch valve 24 and the air tank 84. Consequently, it is possible to prevent the air once accumulated in the air tank 84 from reversely flowing and being discharged to the outside via the exhaust port 28.

The throttle valve 32, the silencer 82, and the exhaust port 28 are connected to the check valve 86 and the air tank 84 in parallel with respect to the fourth port 52. Consequently, it is possible to limit the amount of air discharged to the outside, and further save energy. Further, the throttle valve 32 is the variable throttle valve. Consequently, the throttle valve 32 can easily adjust the ratio of the amount of air discharged from the fourth port 52 and supplied to the air tank 84, to the amount of the air discharged to the outside via the exhaust port 28.

The fluid pressure cylinder 20A employs the same configuration as that of the fluid pressure cylinder 20 in FIGS. 1 and 2 except that the throttle valve 32, the silencer 82, the air tank 84, and the check valve 86 are connected to the fourth port 52. Consequently, the fluid pressure cylinder 20A can naturally easily obtain the same effect as that of the above fluid pressure cylinder 20.

In the fluid pressure cylinder 20A according to this modification, a first fluid supply mechanism 88 is further disposed, When the switch valve 24 is at the second position and when part of air accumulated in the head side cylinder chamber 42 is supplied from the head side cylinder chamber 42 to the rod side cylinder chamber 44 via the check valve 30 and the switch valve 24, the first fluid supply mechanism 88 supplies the air accumulated in the air tank 84 to the rod side cylinder chamber 44.

The first fluid supply mechanism 88 includes a check valve 90 disposed on a tube that connects the air tank 84 and the rod side cylinder chamber 44. In this case, the check valve 90 is disposed on a tube that connects the air tank 84 and the second port 48 to allow a flow of fluid from the air tank 84 toward the second port 48. That is, when the switch valve 24 is at the second position, the check valve 90 allows an air flow from the air tank 84 toward the rod side cylinder chamber 44, and blocks the air flow from the rod side cylinder chamber 44 toward the air tank 84.

In this case, when the switch valve 24 is at the second position and when the air pressure of the air supplied from the head side cylinder chamber 42 to the rod side cylinder chamber 44 becomes lower than the air pressure in the air tank 84, the air accumulated in the air tank 84 is supplied from the air tank 84 to the rod side cylinder chamber 44 via the check valve 90.

Thus, even when the air pressure of the air supplied from the head side cylinder chamber 42 to the rod side cylinder chamber 44 lowers while the piston rod 40 retracts, air in the air tank 84 is supplementarily supplied via the first fluid supply mechanism 88. As a result, a simple configuration where the check valve 90 is provided to a tube makes it possible to keep a moving speed of the piston 38 constant during the retraction, and reliably and efficiently return the piston 38.

The fluid pressure cylinder 20A according to this modification further includes a second fluid supply mechanism 92 that supplies air from the high pressure air supply source 26 to the air tank 84.

The second fluid supply mechanism 92 includes an air-operated valve 94 that is disposed on a tube that connects the high pressure air supply source 26 and the air tank 84. When an air pressure in the air tank 84, which a pilot pressure, is higher than a predetermined threshold, the air-operated valve 94 maintains the second position shown in FIG. 11 and blocks a connection the high pressure air supply source 26 and the air tank 84. Meanwhile, in a case where the air pressure in the air tank 84 has lowered to the threshold, the air-operated valve 94 is switched to the first position and connects the high pressure air supply source 26 and the air tank 84. Thus, the high pressure air supply source 26 supplies a high pressure air to the air tank 84.

Hence, as described above, when the air accumulated in the air tank 84 is supplied from the air tank 84 to the rod side cylinder chamber 44 via the check valve 90 and when the air pressure in the air tank 84 lowers to the threshold, the air-operated valve 94 is switched from the second position to the first position, and the high pressure air supply source 26 supplies the high pressure air to the air tank 84. Consequently, it is possible to prevent the air pressure in the air tank 84 from lowering and supply the high pressure air to the rod side cylinder chamber 44.

As described above, the fluid pressure cylinder 20A further includes the second fluid supply mechanism 92 that supplies the high pressure air from the high pressure air supply source 26 to the air tank 84. Consequently, when air accumulated in the air tank 84 is used, it is possible to prevent the air pressure from lowering.

In the fluid pressure cylinder 20A according to this modification, a permanent magnet 96 is disposed on an outer circumferential surface of the piston 38, and magnetic sensors 98*a*, 98*b* that detect magnetism of the permanent magnet 96 are disposed near the head side cylinder chamber 42 of the cylinder main body 36 and near the rod side cylinder chamber 44, respectively. That is, the magnetic sensor 98*a* is disposed to face the outer circumferential surface of the piston 38 when the piston rod 40 retracts most, and detects the magnetism of the permanent magnet 96 and outputs a detection signal to a PLC when the piston rod 40 retracts most. Meanwhile, the magnetic sensor 98*b* is disposed to face the outer circumferential surface of the piston 38 when the piston rod 40 extends to a maximum position, and detects the magnetism of the permanent magnet 96 and outputs a detection signal to the PLC when the piston rod 40 extends most.

Next, a structure (fluid pressure cylinder 120A) of a specific arrangement of each component of the fluid pressure cylinder 20A shown in the circuit diagram of FIG. 11 will be described with reference to FIGS. 12 to 15. Components of the fluid pressure cylinder 120A corresponding to the components of the fluid pressure cylinder 20A will be assigned reference numerals that are equal to 100 plus the reference numerals of the corresponding components of the fluid pressure cylinder 20A in FIGS. 12 to 15, too, and will not be described in detail.

Figure 14:
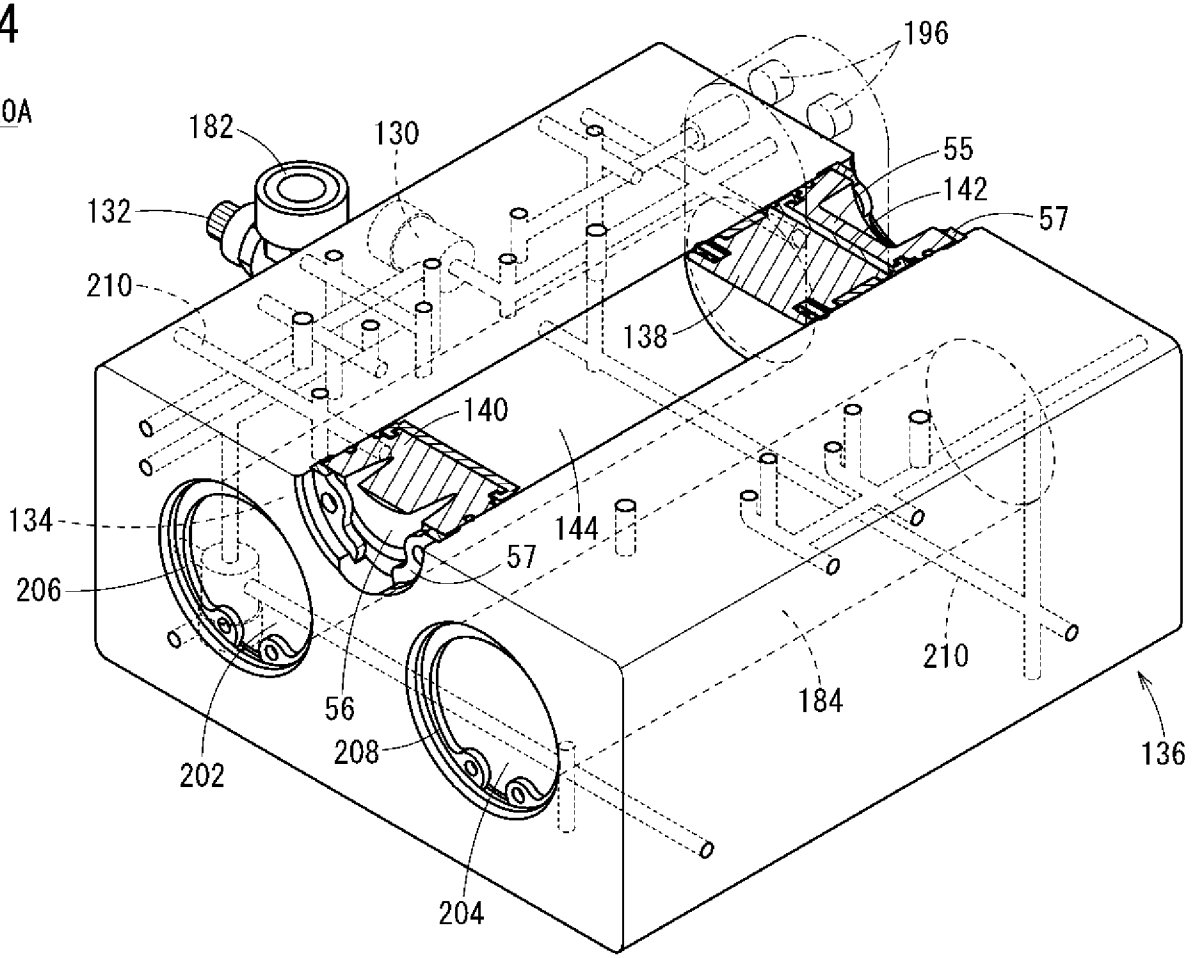
FIG. 14 is a perspective view showing the fluid pressure cylinder in FIG. 12 with a cylinder chamber opened.
Figure 15:
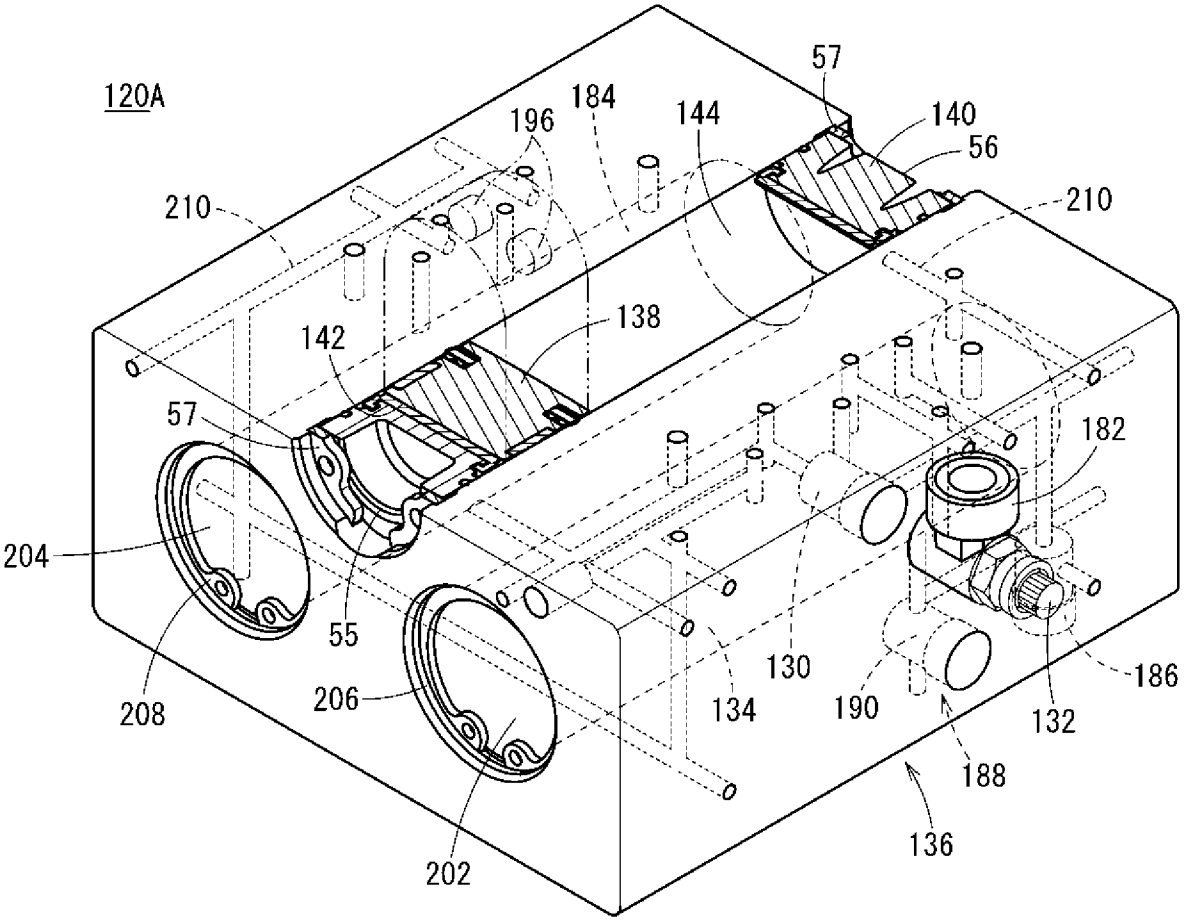
FIG. 15 is a perspective view showing the fluid pressure cylinder in FIG. 13 with a cylinder chamber opened.
Figure 16:
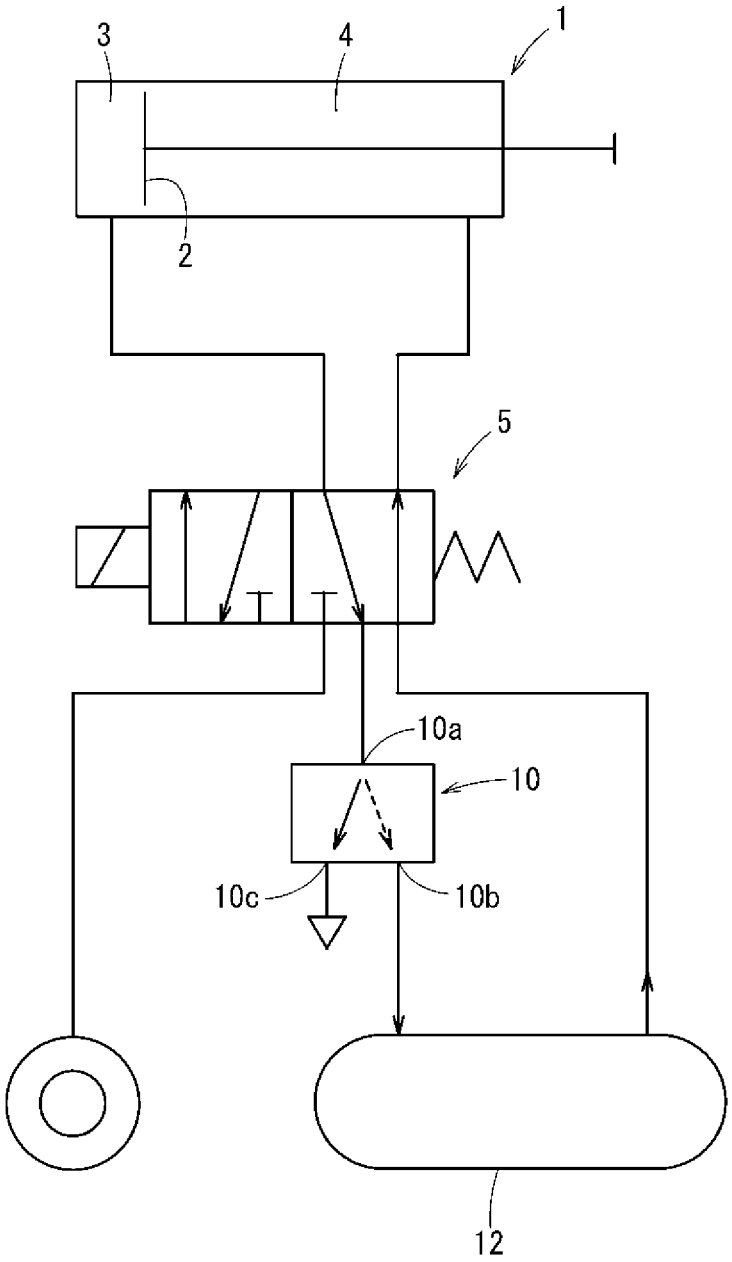
FIG. 16 is a circuit diagram of an actuator driving device according to related art.

The cylinder main body 136 of the fluid pressure cylinder 120A has a reversed T shape in which a central portion of a rectangular shape bulges upward. Inside the bulged portion, the piston rod 140 coupled to the piston 138 extends along the longitudinal direction of the bulged portion, and the head side cylinder chamber 142 and the rod side cylinder chamber 144 are formed. FIGS. 14 and 15 show that the piston rod 140 retracts most and as a result, the volume of the head side cylinder chamber 142 becomes minimum.

Figure 12:
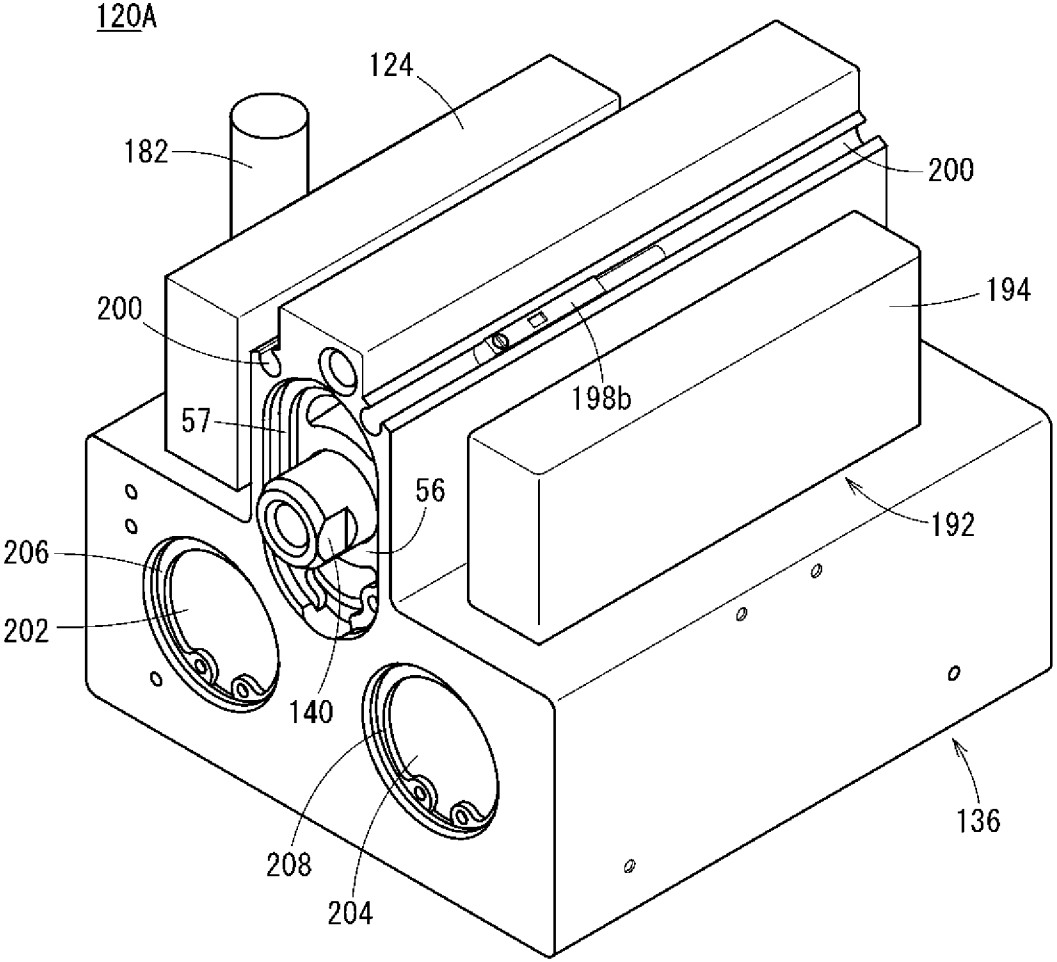
FIG. 12 is a perspective view showing the fluid pressure cylinder according to the modification seen from a piston rod side.
Figure 13:
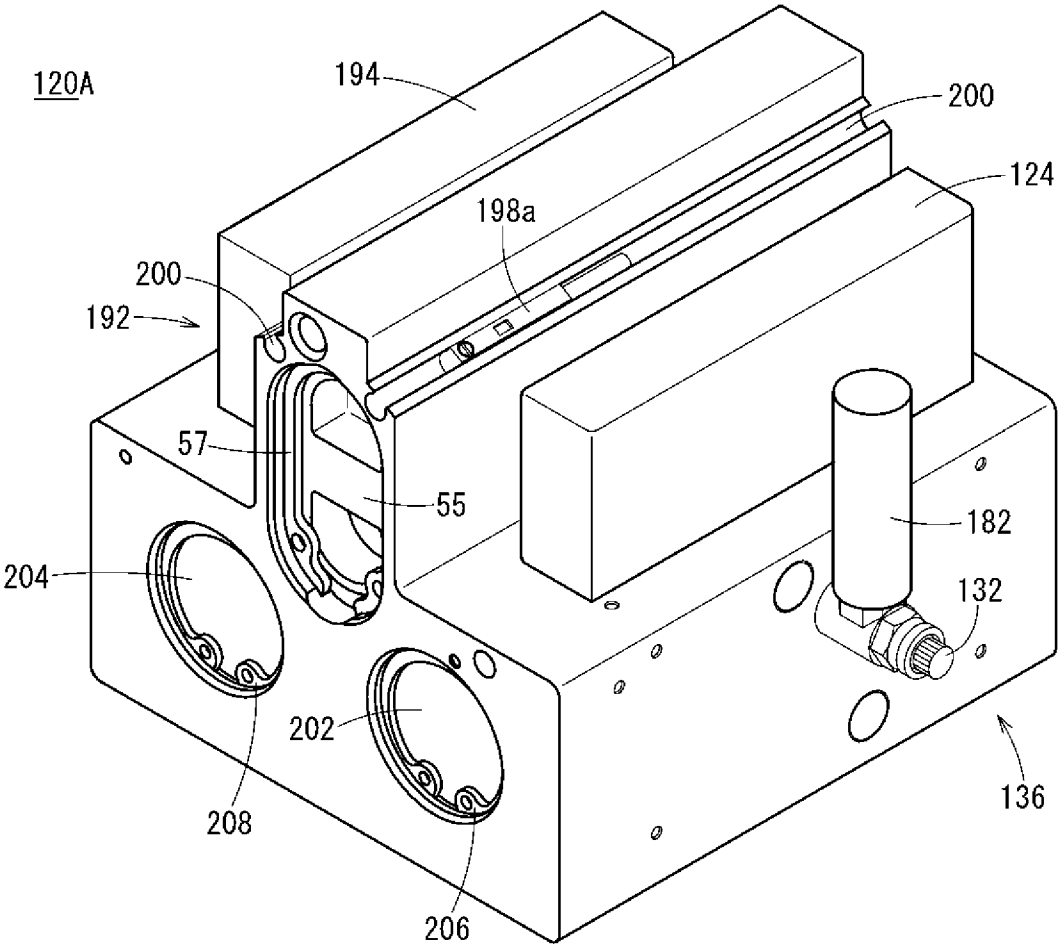
FIG. 13 is a perspective view showing the fluid pressure cylinder according to the modification seen from the head side.

The piston 138 has an elliptical shape along the vertical direction as indicated by dashed lines in FIGS. 14 and 15. Bar-shaped permanent magnets 196 are disposed at the upper portion of the piston 138 on both left and right sides as illustrated in FIGS. 14 and 15. As shown in FIGS. 12 and 13, grooves 200 are formed on both left and right sides at an upper portion of the bulged portion, and along the longitudinal direction of the bulged portion. A magnetic sensor 198*a* is attached to one end side of the one groove 200 (the head side cylinder chamber 142 side). A magnetic sensor 198*b* is attached to the other end side of the other groove 200 (the rod side cylinder chamber 144 side). That is, in the cylinder main body 136, the magnetic sensor 198*a* is disposed near the head side cylinder chamber 142 and the magnetic sensor 198*b* is disposed near the rod side cylinder chamber 144.

The switch valve 124 and an air-operated valve 194 of the second fluid supply mechanism 192 are disposed in parallel with the bulged portion therebetween on an upper surface of the rectangular block. Inside the cylinder main body 136, the air tank 134 is formed below the switch valve 124, and an air tank 184 is formed below the air-operated valve 194.

That is, the air tanks 134, 184 are disposed in parallel along the longitudinal direction of the bulged portion, and have approximately the same volume. The air tanks 134, 184 are closed by cover members 202, 204, and the cover members 202, 204 are fixed by retaining rings 206, 208.

As shown in FIGS. 12 to 15, the check valves 130, 186 and the check valve 190 of the first fluid supply mechanism 188 are built inside the cylinder main body 136 on the air tank 134 side. The throttle valve 132 and a silencer 182 are disposed on a side surface of the cylinder main body 136 near the air tank 134. These components of the cylinder main body 136 are connected by each flow path 210 shown by broken lines in FIGS. 14 and 15. Each flow path 210 corresponds to each tube shown in the circuit diagram in FIG. 11, and therefore a connection relationship of each flow path 210 between the components will not be described in detail.

As described above, the cylinder main body 136 includes the switch valve 124 and the air tank 134, and the air-operated valve 194 and the air tank 184 symmetrically disposed with respect to the piston 138, the piston rod 140, the head side cylinder chamber 142, and the rod side cylinder chamber 144 inside the bulged portion.

Such an arrangement relationship makes it easy to assemble the fluid pressure cylinder 120A. As a result, it is possible to reduce manufacturing cost while improving productivity of the fluid pressure cylinder 120A.

The piston 138 has an elliptical shape along the vertical direction, so that it is possible to prevent the piston 138 from turning in the circumferential direction.

The permanent magnets 196 are disposed at the upper portion of the piston 138, and the magnetic sensors 198*a*, 198*b* are disposed in the grooves 200 formed in the bulged portion of the cylinder main body 136 and near the head side cylinder chamber 142 and the rod side cylinder chamber 144, respectively. The magnetic sensors 198*a*, 198*b* detect the magnetism of the permanent magnets 196. Consequently, it is possible to easily dispose a position detecting mechanism of the piston 138 in the fluid pressure cylinder 120A having the symmetrical structure.

The air tanks 134, 184 have approximately the same volume. Consequently, it is possible to further improve productivity of the fluid pressure cylinder 120A, and further reduce manufacturing cost of the fluid pressure cylinder 120A.

The fluid pressure cylinder according to the present invention is not limited to the above embodiment, and can employ various configurations without departing from the scope of the present invention.

The invention claimed is:

1. A double acting fluid pressure cylinder comprising:

a cylinder main body in which a piston reciprocates; and a switch valve which includes a discharge port and which is fixed to the cylinder main body;

wherein the cylinder main body includes:

a supply check valve arranged inside a wall part which forms the cylinder main body;

a first flow path connecting one cylinder chamber and the switch valve;

a second flow path connecting an other cylinder chamber and the switch valve; and a third flow path being provided with the supply check valve and being derived from the first flow path, wherein the one cylinder chamber is connected with a fluid supply source via the first flow path and the switch valve, and the other cylinder chamber is connected with at least the discharge port via the second flow path when the switch valve is at a first position, and the one cylinder chamber is connected with the other cylinder chamber via the third flow path, the supply check valve, the switch valve and the second flow path, and the one cylinder chamber is also connected with at least the discharge port via the first flow path and the switch valve, when the switch valve is at a second position.

2. The fluid pressure cylinder according to claim 1, wherein the switch valve is arranged at an upper portion of the one cylinder chamber, or at sides of the one cylinder chamber and the other cylinder chamber.

3. A double acting fluid pressure cylinder comprising:

a cylinder main body in which a piston reciprocates; and a switch valve which includes a discharge port;

wherein the cylinder main body includes:

a supply check valve, a first flow path connecting one cylinder chamber and the switch valve;

a second flow path connecting an other cylinder chamber and the switch valve; and a third flow path being provided with the supply check valve and being derived from the first flow path, wherein the one cylinder chamber is connected with a fluid supply source via the first flow path and the switch valve, and the other cylinder chamber is connected with at least the discharge port via the second flow path when the switch valve is at a first position, the one cylinder chamber is connected with the other cylinder chamber via the third flow path, the supply check valve, the switch valve and the second flow path, and the one cylinder chamber is also connected with at least the discharge port via the first flow path and the switch valve, when the switch valve is at a second position, and a first tank is arranged between the other cylinder chamber and the switch valve.

4. The fluid pressure cylinder according to claim 3, wherein the first tank is arranged at an upper portion of the other cylinder chamber or at a lower portion of the switch valve.

5. The fluid pressure cylinder according to claim 3, wherein a volume of the first tank is approximately half a maximum value of a fluctuating volume of the one cylinder chamber.

6. The fluid pressure cylinder according to claim 3, wherein a throttle valve is arranged at the discharge port.

7. The fluid pressure cylinder according to claim 6, wherein the throttle valve is a variable throttle valve.

8. The fluid pressure cylinder according to claim 6, wherein:

a second tank is further arranged and is connected to the throttle valve in parallel with respect to the switch valve;

when the switch valve is at the first position, the other cylinder chamber communicates with the throttle valve and the second tank via the switch valve; and when the switch valve is at the second position, the one cylinder chamber communicates with the other cylinder chamber via the supply check valve and the switch valve, and communicates with the throttle valve and the second tank via the switch valve.

9. The fluid pressure cylinder according to claim 8, wherein a pressure accumulator check valve is arranged between the switch valve and the second tank.

10. The fluid pressure cylinder according to claim 8, wherein a first fluid supply mechanism is further arranged and is configured to supply a fluid accumulated in the second tank to the other cylinder chamber when the switch valve is at the second position and when part of a fluid accumulated in the one cylinder chamber is supplied from the one cylinder chamber to the other cylinder chamber via the supply check valve and the switch valve.

11. The fluid pressure cylinder according to claim 10, wherein a second fluid supply mechanism is further arranged and is configured to supply fluid from the fluid supply source to the second tank.

12. The fluid pressure cylinder according to claim 11, wherein:

the first tank and the second tank are arranged in parallel inside the cylinder main body;

the switch valve is arranged at an upper portion of the first tank, and an air-operated valve is arranged at an upper portion of the second tank and constitutes the second fluid supply mechanism); and the piston, the one cylinder chamber, and the other cylinder chamber are arranged between the switch valve and the air operated valve.

13. The fluid pressure cylinder according to claim 12, wherein the piston has an elliptical shape along a vertical direction.

14. The fluid pressure cylinder according to claim 12, wherein:

a magnet; and magnetic sensors configured to detect magnetism of the magnet are disposed near the one cylinder chamber and the other cylinder chamber in the cylinder main body, respectively.

15. The fluid pressure cylinder according to claim 12, wherein the first tank and the second tank have approximately same volume.

* * * * *